US008297457B2

(12) United States Patent
Kick

(10) Patent No.: US 8,297,457 B2
(45) **Date of Patent: *Oct. 30, 2012**

(54) FLIP TOP CLOSURE FOR DISPENSING FLUENT PRODUCT

(75) Inventor: James Kick, Town and Country, MO (US)

(73) Assignee: C.A.P.S., Inc., Bridgeton, MO (US)

( * ) Notice: Subject to any disclaimer, the term of this patent is extended or adjusted under 35 U.S.C. 154(b) by 85 days.

This patent is subject to a terminal disclaimer.

(21) Appl. No.: 12/911,566

(22) Filed: Oct. 25, 2010

(65) Prior Publication Data

US 2011/0056905 A1 Mar. 10, 2011

Related U.S. Application Data

(63) Continuation of application No. 11/404,177, filed on Apr. 14, 2006, now Pat. No. 7,819,267.

(60) Provisional application No. 60/672,924, filed on Apr. 19, 2005.

(51) Int. Cl.
*B65D 39/00* (2006.01)

(52) U.S. Cl. ..... 215/235; 215/237; 222/556; 220/254.3; 220/254.5; 220/835; 220/838; 220/839

(58) Field of Classification Search ..... 215/224, 215/228, 235, 236, 237; 222/556; 220/810, 220/836, 837, 324, 839, 254.3, 254.5, 835, 220/838

See application file for complete search history.

(56) References Cited

U.S. PATENT DOCUMENTS

| | | | | |
|---|---|---|---|---|
| 3,323,671 | A | 6/1967 | Minarik, Jr. et al. | |
| 4,022,352 | A | 5/1977 | Pehr | |
| 4,291,818 | A | 9/1981 | Nozawa et al. | |
| 4,403,712 | A | 9/1983 | Wiesinger | |
| 4,457,458 | A | 7/1984 | Heinol | |
| 4,911,337 | A | 3/1990 | Rosenthal | |
| 4,936,494 | A | 6/1990 | Weidman | |
| 4,941,592 | A | 7/1990 | Kitterman | |
| 5,038,957 | A | 8/1991 | Gross | |
| D331,878 | S | 12/1992 | Forsyth | |
| RE34,263 | E | 5/1993 | vanKerkhoven et al. | |
| D340,187 | S | 10/1993 | Forsyth | |
| 5,330,082 | A | 7/1994 | Forsyth | |
| 5,499,736 | A | 3/1996 | Kohl | |
| 5,769,253 | A | 6/1998 | Gross | |
| 6,039,197 | A | 3/2000 | Braun | |
| RE37,634 | E | 4/2002 | Hickman et al. | |
| 6,510,971 | B1 | 1/2003 | Martin | |
| D476,892 | S | 7/2003 | Martin | |
| 7,819,267 | B2 * | 10/2010 | Kick | 215/235 |
| 2002/0125203 | A1 | 9/2002 | Bried et al. | |

* cited by examiner

*Primary Examiner* — Anthony Stashick

*Assistant Examiner* — Elizabeth Volz

(74) *Attorney, Agent, or Firm* — Polster, Lieder, Woodruff & Lucchesi, L.C.

(57) ABSTRACT

A closure for a container including a downwardly depending skirt having an upper end and a bottom end and a periphery defining a perimeter of the closure for sealable connection to the mouth of said container. Each of two side edges of the lid has a proximal end adjacent a different side of the hinge on the skirt and angling outwardly from the hinge at increasing distances from the opposing side edge to a distal end defining a different end of the outer edge. The end wall has shoulders integrally formed with the end wall and skirt proximate the upper end of the skirt on opposite sides of the lid hinge. The shoulders extend across portions of the end wall such that the thickness of the end wall in the regions of said shoulders is thicker than a thickness of said end wall free of the shoulders.

20 Claims, 2 Drawing Sheets

FLIP TOP CLOSURE FOR DISPENSING FLUENT PRODUCT

CROSS-REFERENCE TO RELATED APPLICATIONS

This application is a continuation of U.S. patent application Ser. No. 11/404,177 filed on Apr. 14, 2006, to be issued as U.S. Pat. No. 7,819,267, and claims priority to U.S. Provisional Application Ser. No. 60/672,924, filed Apr. 19, 2005. The disclosures of the above applications are incorporated herein by reference.

FIELD

The present disclosure relates to container and, more specifically, to closures for holding and dispensing products that may be poured, shaken, or spooned from the container.

BACKGROUND

The statements in this section merely provide background information related to the present disclosure and may not constitute prior art.

This invention relates to a closure for consumer containers as may be used to package spices, sugar, powdered drink mixes, salt or other dry, fluent (flowable) materials or products. More specifically, this invention relates to such a closure which may be used with small containers with a flip open lid that exposes one or more product dispensing holes through which the product may be poured, shaken or spooned from the container.

In the high-speed packaging of dry, fluent products, a premeasured quantity (either a pre-determined weight or volume) of the product is discharged into the container. Oftentimes, a tamper-evident, tear-off seal is adhered to the mouth of the container after filling of the container. These containers typically have a screw-on closure which is threaded onto the threaded neck of the container by high-speed capping equipment incorporated in the product filling line. Such capping equipment oftentimes applies more torque to the closure than is necessary to insure that the closure is tightly screwed onto the container. In the past, this excess torque applied to the closure caused the closure to deform as it was screwed tightly to the container, which, in turn, caused a flip open lid formed with the closure to become unseated from the remainder of the closure and to partially open or to open. With the lid in a partially open position, the container could become jammed in the filling line, or the partially open lids would not allow the containers to be packaged in overcartons using automated equipment. In addition, such partially open lids may cause the filled package to be automatically rejected by the filling line or by inspectors. Still further, even if the lid would remain closed during filling and packing in overcartons, the stress imposed on the closure during the capping operation would, on occasion, cause the flip open lids to become unseated during shipping or while the container was on a store shelf prior to being purchased by a consumer. Such partially open lids would cause the container to be seen by the store clerks or the consumer as defective because the clerk or the consumer may believe that the product had been opened or contaminated, even though a taper-evident seal applied to the mouth of the container under the closure remained intact. As will be appreciated, such containers having the above-described tamper-evident seals applied to the mouth of the container must be removed prior to use by unscrewing the closure from the container, removing the seal, and then screwing the closure back onto the container. On occasion, the consumer (customer) may, when using the container, over-tighten the closure thus resulting in a similar deformation such that the flip open lid will not stay in its closed position. This, of course, my result in the spillage of the contents of the container or it may result in the degradation of the contents.

There has long been a need for a flip open, screw-on closure that better resisted deformation during the capping operation, particularly if the closure was screwed onto the container with more torque than was necessary. There has also been a need for such a flip-open closure where the lid will remain secured in its closed position during shipping, and while the product is displayed on store shelves and is used by the consumer.

SUMMARY

The inventor hereof has succeeded at designing a new closure having a flip open lid where the closure resists deformation upon being tightly applied (e.g., screwed) onto its container either by automated capping equipment or by hand thereby insuring that its flip open lid remains closed;

The provision of such a closure that has a flush upper surface when the flip open lid is in its closed position, while resisting deformation caused by over-torquing, is of lightweight construction, which is easy to mold, and which is economical to manufacture.

According to one aspect, a closure for a container, the container having a neck and a mouth at an upper end of said neck. The closure including a downwardly depending skirt having an upper end and a bottom end and a periphery defining a perimeter of the closure for sealable connection to the mouth of said container. The closure also has an end wall with a top surface coupled to and extending diametrically across the upper end of said skirt and about a substantial portion of the periphery for closing the upper end of said skirt and the mouth of said container when said closure is applied to said container. The end wall has an area defined within the upper end of the skirt defining one or more openings therethrough for the dispensing of a product contained within said container. The closure also includes a flip-open lid hingedly connected by a hinge to a side of the skirt about the perimeter of said closure for movement of said lid relative to said end wall between a closed position in which said lid overlies and closes said one or more openings in said end wall and an open position in which said lid is clear of said one or more openings for permitting the dispensing of said product. The lid has two side edges and an outer edge defining a portion of a periphery of the lid and a top lid surface. Each side edge has a proximal end adjacent a different side of the hinge on the skirt and angling outwardly from the hinge at increasing distances from the opposing side edge to a distal end defining a different end of the outer edge. The closure includes a snap lock for retaining said lid in its closed position. The end wall have shoulders integrally formed with said end wall and said skirt proximate the upper end of said skirt on opposite sides of said lid hinge. Each shoulder has a substantial portion formed as an upward extension of the skirt and an insubstantial portion located above the end wall free of the skirt. The shoulders extend upwardly from the top surface of the end wall and proximate to and spaced upwardly from a portion of a periphery of the end wall with each shoulder having a proximal end adjacent one side of the hinge and an inner side edge angling outwardly away from the hinge and corresponding to the angle of the side edges of the lid, a distal end at about the periphery of the skirt, the inner edge defined between the proximal end and the distal end, a peripheral surface extending upward from the periphery and spaced upwardly from the upper end of the skirt and extending upwardly from the top surface of the end wall defining a top shoulder surface that is substantially flush with the top lid surface when the lid is in the closed position. The shoulders at least in part extend across portions of said end wall such that the thickness of said end wall in the regions of said shoulders is substantially thicker than a thickness of said end wall free of the shoulders.

According to yet another aspect, a closure for a container, the container having a neck and a mouth at an end of the neck. The closure including a downwardly depending skirt for sealable connection to the mouth of the container, the skirt has an upper edge, a lower edge, an inner surface and an outer surface defining a periphery of the skirt and a perimeter of the closure. An end wall is coupled at the upper edge of the skirt and extending diametrically across the upper edge of the skirt for closing the skirt and for closing the container when the closure is applied to the container. The end wall has a top surface extending about a substantial portion of the periphery, an area defined by the upper edge of the skirt and an opening therethrough for the dispensing of a product contained within the container. A flip-open lid is configured for moving over the end wall between an open position for exposing the opening and a closed position for closing the opening. The lid has a snap lock for selectively securing the lid in the closed position. The lid has two linear side edges outwardly angled at increasing distances apart from each other from a proximal end and a distal end, and a semi-circular outer edge defined between the distal ends of the two side edges and a top lid surface. A hinge is integrally formed with the lid and a side of the skirt and configured for hingedly connecting the flip-open lid for the movement of the lid relative to the end wall between the closed position in which the lid closes the opening in the end wall and the open position in which the lid is clear of the opening for permitting the dispensing of the product through the opening. Each proximal end of the two side edges of the lid are proximate to a different side of the hinge. A pair of shoulders is integrally formed with the end wall and the skirt. Each shoulder extends upwardly from the end wall and is spaced upwardly from the upper edge of the skirt. Each shoulder is symmetrically positioned on opposing sides of the hinge in a position that angles outwardly from the hinge at the same angle as one of the side edges of the lid. The shoulders have a top surface and have inner linear edges configured for receiving the side edges of the lid between the two shoulders when the lid is in the closed position. The lid is dimensioned to substantially overlay the area of the end wall free of the shoulders and the upper edge of the skirt free of the shoulders. A thickness of the end wall containing the shoulders is substantially greater than a thickness of the end wall free of the shoulders.

In yet another aspect, a closure for a container, the container having a neck and a mouth at an upper end of said neck. The closure includes a downwardly depending skirt having an upper end and a bottom end and a periphery defining a perimeter of the closure for sealable connection to the mouth of said container. An end wall has a top surface coupled to and extends diametrically across the upper end of said skirt and about a substantial portion of the periphery for closing the upper end of said skirt and the mouth of said container when said closure is applied to said container. The end wall has an area defined within the upper end of the skirt defining one or more openings therethrough for the dispensing of a product contained within said container. The end wall has a lower surface defining a void in the region below the shoulders. A flip-open lid is hingedly connected by a hinge to a side of the skirt about the perimeter of said closure for movement of said lid relative to said end wall between a closed position in which said lid overlies and closes said one or more openings in said end wall and an open position in which said lid is clear of said one or more openings for permitting the dispensing of said product. The lid has two side edges and an outer edge defining a portion of a periphery of the lid and a top lid surface. Each side edge has a proximal end adjacent a different side of the hinge on the skirt and angling outwardly from the hinge at increasing distances from the opposing side edge to a distal end defining different end of the outer edge. A snap lock is provided for retaining said lid in its closed position. The end wall has shoulders integrally formed with said end wall and said skirt proximate the upper end of said skirt on opposite sides of said lid hinge. The shoulders extend upwardly from the top surface of the end wall and proximate to and spaced upwardly from a portion of a periphery of the end wall with each shoulder having a proximal end adjacent one side of the hinge and an inner side edge angling outwardly away from the hinge and corresponding to the angle of the side edges of the lid, a distal end at about the periphery of the skirt, the inner edge defined between the proximal end and the distal end, a peripheral surface extending upward from the periphery and spaced upwardly from the upper end of the skirt and extending upwardly from the top surface of the end wall defining a top shoulder surface that is substantially flush with the top lid surface when the lid is in the closed position. Each shoulder is integrally formed as an upward extension of the end wall wherein the end wall has no upward extension spaced apart upwardly from the plane of the end wall other than the shoulders and each shoulder includes an upward extension of the skirt that is spaced upwardly from the upper end of the skirt to the top shoulder surface.

Further aspects of the present invention will be in part apparent and in part pointed out below. It should be understood that various aspects of the disclosure may be implemented individually or in combination with one another. It should also be understood that the detailed description and drawings, while indicating certain exemplary embodiments, are intended for purposes of illustration only and should not be construed as limiting the scope of the disclosure.

BRIEF DESCRIPTION OF THE DRAWINGS

Corresponding reference characters indicate corresponding parts throughout the several views of the drawings. It should be understood that throughout the drawings, corresponding reference numerals indicate like or corresponding parts and features.

DETAILED DESCRIPTION

The following description is merely exemplary in nature and is not intended to limit the present disclosure or the disclosure's applications or uses.

Figure 5:
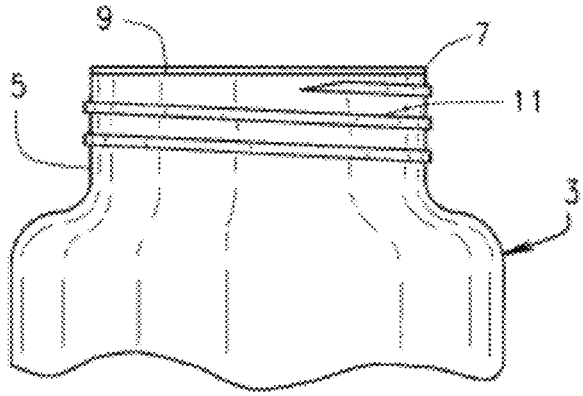
FIG. 5 is a side elevational view of a typical container to which the closure of this invention is threadably applied.

Referring now to the drawings, one embodiment of the closure of the present invention is indicated in its entirety by reference character 1. The closure is adapted to be applied, preferably (but not necessarily) threaded, onto a container 3. As shown in FIG. 5, container 3 has a neck 5 with the mouth 7 of the container at the upper end of the neck. As is conventional, a tear away tamper evident seal 9 is adhered to the mouth of the container. External threads 11 are formed on the outer surface of the container neck so that the closure 1 may be screwed onto the neck of the container in the conventional manner.

Figure 4:
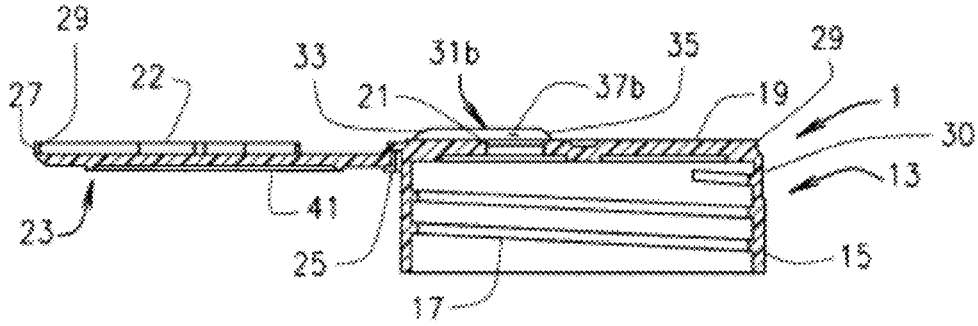
FIG. 4 a cross sectional view taken along line 4-4 of FIG. 3 with the flip open lid in its open position is shown in FIG. 3.

Closure 1 has a lower body portion, as generally indicated at 13, having a downwardly extending cylindrical skirt 15. As shown in FIG. 4, internal threads 17 are formed on the inner wall of skirt 15 for threadable engagement with threads 11 on the neck of its container 3 so that closure may be sealably secured to the container. While the closure is preferably threadably secured to its container, those skilled in the art will understand that the closure may be secured to the container by other suitable means well-known in the closure field, such as using a push-in closure which is adhered to its container by an adhesive. Such a "push in" skirt is shown in U.S. Pat. RE 34,263, which is herein incorporated by reference.

Closure 1 has an upper end wall 19 extending diametrically across the upper end of lower body portion 13 and closing the closure and the upper end of container 3. The end wall is provided with one or more product dispensing openings, as indicated at 21. It will be understood that the number and size of the openings may be varied, depending on the product to be contained in container 3 and the method of dispensing that is desired for the product. As shown, five (5) of such product openings are used where each opening is relatively large. Such openings are preferable when dispensing a flowable or fluent, dry product such as Parmesan cheese or flake spices (e.g., basil or parsley). Those skilled in the art will appreciate that smaller opening may be preferred in dispensing products having a finer granular form, such as popcorn salt or the like. For such fine products, more than five (5) holes may be preferred. For certain products, particularly products used in baking, such as baking powder, where the end-user spoons the product from the container, only a single opening for accommodating a spoon may be preferred. Also, those skilled in the art will understand that for closures of a larger size than is shown in the drawings, a combination of different groups of openings may be used for different dispensing applications.

Further, closure 1 has a flip-open lid, as generally indicated at 23, which is hingedly connected to the upper portion of lower body portion 13 by a hinge 25 integrally molded to skirt 15 and to lid 23. Preferably, hinge 25 is adjacent the periphery of the closure. While a number of different hinge designs may be used, a so-called "bow tie" hinge design is preferred. Such "bow tie" hinges are well known to those skilled in the closure field. Lid 23 has a distal edge end 27 generally opposite hinge 25 and a snap lock closure 29 carried by the distal edge of the lid opposite the hinge. A variety of snap lock closures for such flip open lids are widely used in the closure field and any of these well known designs would be suitable for use with the closure of the present invention. These snap lock closures typically operate to engage a portion of the lid with a receptacle in the upper edge of the lower body portion 13 when the lid is forced to its fully closed position. In order to open such snap locks, a fingernail groove 30 is provided in the upper edge of the lower body portion 13 of the closure so that an end-user may more readily grip only the lid 23 to force it open.

Figure 1:
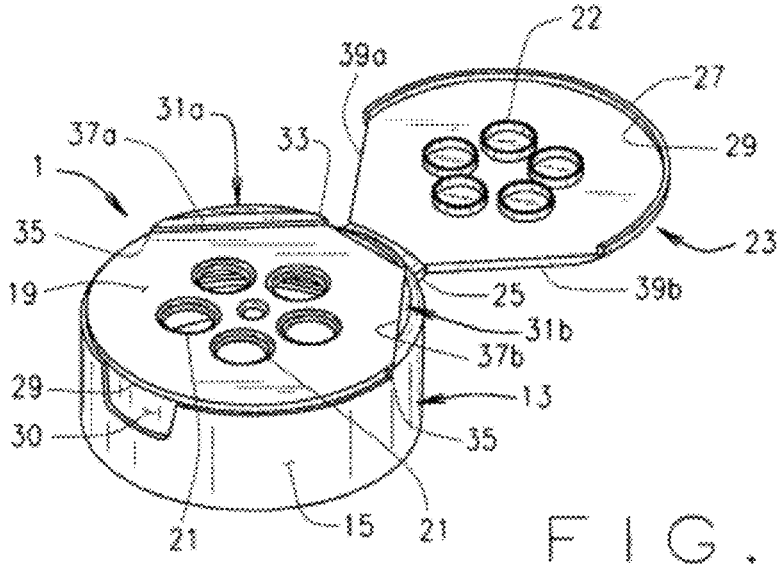
FIG. 1 is a perspective view of one embodiment of the closure of the present invention having a lower body portion, and end wall, and a flip-open lid in its open position.
Figure 2:
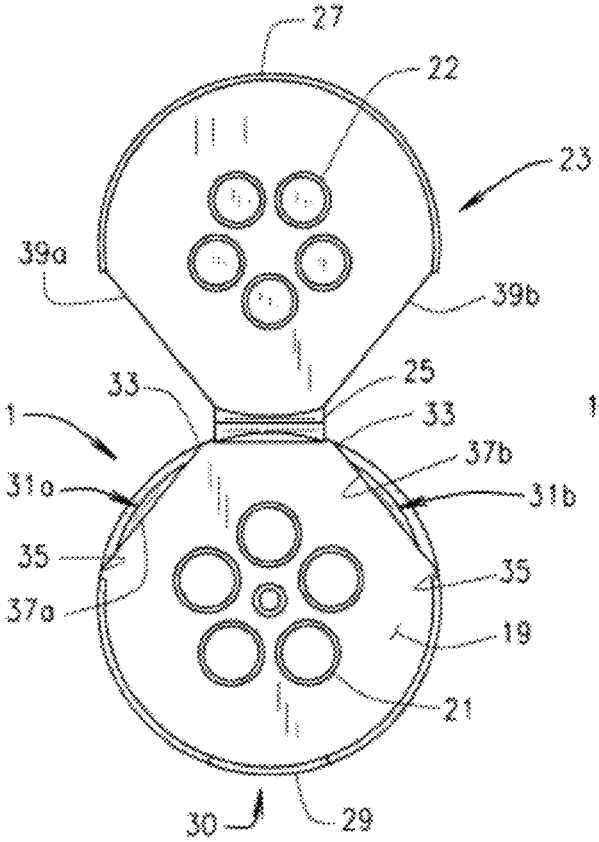
FIG. 2 is top plan view of the closure with its flip-open lid in its fully open position.

As best shown in FIGS. 1 and 2, the underside of lid 23 may optionally be provided with bosses 22 configured to be tightly received in holes 21 when the lid is in its closed position so as to aid in sealing the container when the lid is closed.

Figure 3:
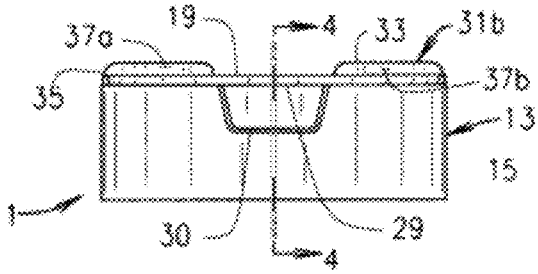
FIG. 3 is a front side elevational view of the closure shown in FIG. 1 with the flip-open lid in its closed position.

As generally indicated at 31*a*, 31*b* and as best shown in FIGS. 1 and 2, a pair of stiffening shoulders is integrally formed or molded with closure 1, and more specifically molded with the upper edges of lower body portion 13 and with end wall 19. Each stiffening shoulder has a proximate end 33 adjacent hinge 25 and a distal end 35. As shown and as is preferable, the stiffening shoulders 31*a*, 31*b* are symmetrical with respect to a diametric centerline of the closure passing through hinge 25 such that the stiffening shoulders are substantially identical and are symmetrical with respect to the hinge. Each of the stiffening shoulders 31*a*, 31*b* has an inner edge 37*a*, 37*b*. Lid 23 has a corresponding side edge 39*a*, 39*b* inboard of shoulders 31*a*, 31*b* so as to be in close proximity to the inner edges 37*a*, 37*b* of the shoulders. As shown in FIGS. 1, 3 and 4, shoulders 31*a*, 31*b* extend up above the level of end wall 19 such that the container is substantially thicker (and thus stiffer) in the areas of the stiffening shoulders. Those skilled in the art will appreciate that the stiffening shoulders thus stiffen and resist deformation of the closure as it is forcibly threaded onto container 3. It will be understood that the stiffening shoulders of closure 1 make it less likely for the closure to be deformed when it is screwed onto the container and thus the tendency of flip lid 23 to come open, during filling, shipping, retail display, and during use by the end user is minimized.

As will be appreciated, flip lid 23 has an upper surface 41 (as shown in Fir. 4). When the flip lid is in its closed position, the height of the flip lid corresponds to the height of the stiffening shoulders 31*a*, 31*b* such that the top surfaces of the stiffening shoulders and the top surface of the flip lid are substantially flush with one another (co-planar). That is, with the flip lid closed, the lid does not protrude above the level of the stiffening shoulders, unless some decorative design is molded on the upper surface of the flip lid.

Depending on the shape and/or size of closure 1, other arrangements of the stiffening shoulders of this invention may be employed. For example, on larger size closures, each of the stiffening shoulders may have two or more segments similar to shoulders 31*a*, 31*b* shown in FIG. 2 with the outermost segment extending from the outer end of the first segment so as to extend around the periphery of the closure toward snap lock 29 thereby to provide additional stiffening of distal from the hinge such larger size closures.

While the present invention has been described by reference to specific embodiments, it should be understood that modifications and variations of the invention may be constructed without departing from the scope of the invention defined in the following claims.

When describing elements or features and/or embodiments thereof, the articles "a", "an", "the", and "said" are intended to mean that there are one or more of the elements or features. The terms "comprising", "including", and "having" are intended to be inclusive and mean that there may be additional elements or features beyond those specifically described.

Those skilled in the art will recognize that various changes can be made to the exemplary embodiments and implementations described above without departing from the scope of the disclosure. Accordingly, all matter contained in the above description or shown in the accompanying drawings should be interpreted as illustrative and not in a limiting sense.

It is further to be understood that the processes or steps described herein are not to be construed as necessarily requiring their performance in the particular order discussed or illustrated. It is also to be understood that additional or alternative processes or steps may be employed.

What is claimed is:

1. A closure for a container, the container having a neck and a mouth at an upper end of said neck, said closure comprising:

a downwardly depending skirt having an upper end and a bottom end and a periphery defining a perimeter of the closure for sealable connection to the mouth of said container, an end wall having a top surface coupled to and extending diametrically across the upper end of said skirt and about a substantial portion of the periphery for closing the upper end of said skirt and the mouth of said container when said closure is applied to said container, said end wall having an area defined within the upper end of the skirt defining one or more openings therethrough for the dispensing of a product contained within said container, a flip-open lid hingedly connected by a hinge to a side of the skirt about the perimeter of said closure for movement of said lid relative to said end wall between a closed position in which said lid overlies and closes said one or more openings in said end wall and an open position in which said lid is clear of said one or more openings for permitting the dispensing of said product, the lid having two side edges and an outer edge defining a portion of a periphery of the lid and a top lid surface, each side edge having a proximal end adjacent a different side of the hinge on the skirt and angling outwardly from the hinge at increasing distances from the opposing side edge to a distal end defining a different end of the outer edge, and a snap lock for retaining said lid in its closed position, wherein said end wall having shoulders integrally formed with said end wall and said skirt proximate the upper end of said skirt on opposite sides of said lid hinge, each shoulder having a substantial portion formed as an upward extension of the skirt and an insubstantial portion located above the end wall free of the skirt, said shoulders extending upwardly from the top surface of the end wall and proximate to and spaced upwardly from a portion of a periphery of the end wall with each shoulder having a proximal end adjacent one side of the hinge and an inner side edge angling outwardly away from the hinge and corresponding to the angle of the side edges of the lid, a distal end at about the periphery of the skirt, the inner edge defined between the proximal end and the distal end, a peripheral surface extending upward from the periphery and spaced upwardly from the upper end of the skirt and extending upwardly from the top surface of the end wall defining a top shoulder surface that is substantially flush with the top lid surface when the lid is in the closed position, wherein said shoulders at least in part extend across portions of said end wall such that the thickness of said end wall in the regions of said shoulders is substantially thicker than a thickness of said end wall free of the shoulders.

2. The closure of claim 1 wherein said side edges of the lid extending from said hinge such that when said lid is in its closed position, said outwardly angled lid side edges are inboard of and contiguous to the outwardly angled inner edges of said shoulders.

3. The closure of claim 1 wherein each shoulder being integrally formed as an upward extension of the end wall and each shoulder includes an upward extension of the skirt that is spaced upwardly from the upper end of the skirt to the top shoulder surface.

4. The closure of claim 1 wherein the end wall has a lower surface defining a void in the region below the shoulders.

5. The closure of claim 1 wherein the shoulders are a pair of shoulders, each shoulder of the pair being positioned on opposing sides of the hinge, and wherein each shoulder of the pair is symmetrical with respect to the hinge and with respect to a centerline of the end wall defined by the hinge.

6. The closure of claim 1 wherein the side edges of the lid are inboard of the inner edge of the shoulders and the top surface of the lid is substantially planar with the top surface of each shoulder when the lid is in the closed position.

7. The closure of claim 1 wherein the lid is dimensioned to cover all of the area of the end wall including the upper end of the skirt other than the shoulders.

8. The closure of claim 1 wherein the outer edge of the lid extends over the upper end of the skirt and wherein a substantially planar top surface of the closure has an area defined by the perimeter consists of the top surface of the lid and the top surface of the shoulders when the lid is in the closed position.

9. The closure of claim 1 wherein the end wall has an area defined by the upper end of the skirt and wherein the lid is dimensioned to cover the area of the end wall free of the shoulders and to cover the upper end of the skirt free of the shoulders when the lid is in the closed position.

10. The closure of claim 9 wherein each shoulder has a proximal end positioned proximate to a different side of the hinge and originating at the periphery of the skirt, a distal end located proximate to the periphery of the skirt and opposing the hinge, the top surface of each shoulder being substantially parallel to the top surface of the end wall, and a peripheral surface defined as a substantially contiguous upward extension of the periphery of the skirt, wherein a top surface of the closure consists of the top surface of the shoulders and the top surface of the lid when in the closed position.

11. A closure for a container, the container having a neck and a mouth at an end of the neck, the closure comprising:

a downwardly depending skirt for sealable connection to the mouth of the container, the skirt having an upper edge, a lower edge, an inner surface and an outer surface defining a periphery of the skirt and a perimeter of the closure;

an end wall coupled at the upper edge of the skirt and extending diametrically across the upper edge of the skirt for closing the skirt and for closing the container when the closure is applied to the container, the end wall having a top surface extending about a substantial portion of the periphery, an area defined by the upper edge of the skirt and an opening therethrough for the dispensing of a product contained within the container;

a flip-open lid configured for moving over the end wall between an open position for exposing the opening and a closed position for closing the opening, the lid having a snap lock for selectively securing the lid in the closed position, the lid having two linear side edges outwardly angled at increasing distances apart from each other from a proximal end and a distal end, and a semi-circular outer edge defined between the distal ends of the two side edges and a top lid surface;

a hinge integrally formed with the lid and a side of the skirt and configured for hingedly connecting the flip-open lid for the movement of the lid relative to the end wall between the closed position in which the lid closes the opening in the end wall and the open position in which the lid is clear of the opening for permitting the dispensing of the product through the opening, wherein each proximal end of the two side edges of the lid are proximate to a different side of the hinge; and a pair of shoulders integrally formed with the end wall and the skirt, each shoulder extending upwardly from the end wall and spaced upwardly from the upper edge of the skirt, each shoulder being symmetrically positioned on opposing sides of the hinge in a position that angles outwardly from the hinge at the same angle as one of the side edges of the lid, the shoulders having a top surface and having inner linear edges configured for receiving the side edges of the lid between the two shoulders when the lid is in the closed position, wherein the lid is dimensioned to substantially overlay the area of the end wall free of the shoulders and the upper edge of the skirt free of the shoulders, wherein a thickness of the end wall containing the shoulders is substantially greater than a thickness of the end wall free of the shoulders.

12. The closure of claim 11 wherein the shoulders being integrally formed as an upward extension of the end wall that has no upward extension spaced apart upwardly from the plane of the end wall other than the shoulders and an upward extension of the skirt and wherein each of the shoulders has a substantially solid formation.

13. The closure of claim 11 wherein the end wall has a lower surface defining a void in the region below the shoulders.

14. A closure for a container, the container having a neck and a mouth at an upper end of said neck, said closure comprising:

a downwardly depending skirt having an upper end and a bottom end and a periphery defining a perimeter of the closure for sealable connection to the mouth of said container, an end wall having a top surface coupled to and extending diametrically across the upper end of said skirt and about a substantial portion of the periphery for closing the upper end of said skirt and the mouth of said container when said closure is applied to said container, said end wall having an area defined within the upper end of the skirt defining one or more openings therethrough for the dispensing of a product contained within said container, wherein the end wall has a lower surface defining a void in the region below the shoulders;

a flip-open lid hingedly connected by a hinge to a side of the skirt about the perimeter of said closure for movement of said lid relative to said end wall between a closed position in which said lid overlies and closes said one or more openings in said end wall and an open position in which said lid is clear of said one or more openings for permitting the dispensing of said product, the lid having two side edges and an outer edge defining a portion of a periphery of the lid and a top lid surface, each side edge having a proximal end adjacent a different side of the hinge on the skirt and angling outwardly from the hinge at increasing distances from the opposing side edge to a distal end defining a different end of the outer edge, and a snap lock for retaining said lid in its closed position, wherein said end wall having shoulders integrally formed with said end wall and said skirt proximate the upper end of said skirt on opposite sides of said lid hinge, said shoulders extending upwardly from the top surface of the end wall and proximate to and spaced upwardly from a portion of a periphery of the end wall with each shoulder having a proximal end adjacent one side of the hinge and an inner side edge angling outwardly away from the hinge and corresponding to the angle of the side edges of the lid, a distal end at about the periphery of the skirt, the inner edge defined between the proximal end and the distal end, a peripheral surface extending upward from the periphery and spaced upwardly from the upper end of the skirt and extending upwardly from the top surface of the end wall defining a top shoulder surface that is substantially flush with the top lid surface when the lid is in the closed position, wherein each shoulder being integrally formed as an upward extension of the end wall wherein the end wall has no upward extension spaced apart upwardly from the plane of the end wall other than the shoulders and each shoulder includes an upward extension of the skirt that is spaced upwardly from the upper end of the skirt to the top shoulder surface.

15. The closure set forth in claim 14 wherein said shoulders at least in part extend across portions of said end wall such that the thickness of said end wall in the regions of said shoulders is substantially thicker than a thickness of said end wall free of the shoulders.

16. The closure of claim 14 wherein said side edges of the lid extending from said hinge such that when said lid is in its closed position, said outwardly angled lid side edges are inboard of and contiguous to the outwardly angled inner edges of said shoulders.

17. The closure of claim 14 wherein the shoulders are a pair of shoulders, each shoulder of the pair being positioned on opposing sides of the hinge, and wherein each shoulder of the pair is symmetrical with respect to the hinge and with respect to a centerline of the end wall defined by the hinge.

18. The closure of claim 14 wherein the end wall has an area defined by the upper end of the skirt and wherein the lid is dimensioned to cover the area of the end wall free of the shoulders and to cover the upper end of the skirt free of the shoulders when the lid is in the closed position.

19. The closure of claim 14 wherein the lid is dimensioned to cover all of the area of the end wall including the upper end of the skirt other than the shoulders.

20. The closure of claim 14 wherein the outer edge of the lid extends over the upper end of the skirt and wherein a substantially planar top surface of the closure has an area defined by the perimeter consists of the top surface of the lid and the top surface of the shoulders when the lid is in the closed position.

* * * * *